US007635661B2

(12) United States Patent
Iida et al.

(10) Patent No.: US 7,635,661 B2
(45) **Date of Patent: *Dec. 22, 2009**

(54) HEAT-SENSITIVE RECORDING MATERIAL

(75) Inventors: Takeshi Iida, Amagasaki (JP); Takeshi Shikano, Amagasaki (JP)

(73) Assignee: OJI Paper Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/793,683

(22) PCT Filed: Dec. 13, 2005

(86) PCT No.: PCT/JP2005/022859

§ 371 (c)(1),
(2), (4) Date: Jun. 22, 2007

(87) PCT Pub. No.: WO2006/070594

PCT Pub. Date: Jul. 6, 2006

(65) Prior Publication Data

US 2007/0270309 A1 Nov. 22, 2007

(30) Foreign Application Priority Data

Dec. 27, 2004 (JP) ..... 2004-376330

(51) Int. Cl.
*B41M 5/42* (2006.01)

(52) U.S. Cl. ..... 503/207; 503/200; 503/226

(58) Field of Classification Search ..... None
See application file for complete search history.

(56) References Cited

U.S. PATENT DOCUMENTS 4,509,064 A * 4/1985 Usui et al. ..... 503/207
4,583,103 A * 4/1986 Hayashi et al. ..... 503/209
5,266,397 A * 11/1993 Ogawa et al. ..... 428/323
6,656,880 B2 * 12/2003 Aono ..... 503/207
2002/0058590 A1 5/2002 Aono ..... 503/226

FOREIGN PATENT DOCUMENTS

| | | | |
|---|---|---|---|
| JP | 59-22794 | A | 2/1984 |
| JP | 59-26292 | A | 2/1984 |
| JP | 62-176878 | A | 8/1987 |
| JP | 1-214472 | A | 8/1989 |
| JP | 2-223471 | A | 9/1990 |
| JP | 5-294065 | A | 11/1993 |
| JP | 7-76172 | A | 3/1995 |
| JP | 8-197848 | A | 8/1996 |
| JP | 8-310132 | A | 11/1996 |
| JP | 9-142016 | A | 6/1997 |
| JP | 10-857 | A | 1/1998 |
| JP | 10-151855 | A | 6/1998 |
| JP | 11-313354 | A | 11/1999 |
| JP | 2001-191643 | A | 7/2001 |
| JP | 2003-11519 | A | 1/2003 |
| JP | 2003-34083 | A | 2/2003 |
| JP | 2004-25775 | A | 1/2004 |
| JP | 2004-90300 | A | 3/2004 |
| JP | 2004-269311 | A | 9/2004 |
| JP | 2005-103864 | * | 4/2005 |

OTHER PUBLICATIONS

"Kami Parupu Technique Times" (paper Pulp Technique Times), 27 (8), 34 (1984).

* cited by examiner

*Primary Examiner*—Bruce H Hess
(74) *Attorney, Agent, or Firm*—Kubovcik & Kubovcik

(57) ABSTRACT

A heat-sensitive recording material has a support, and a heat-sensitive recording layer including at least a leuco dye, a developer and a binder. The heat-sensitive recording layer contains secondary particles with an average particle diameter of 30 to 900 nm formed by aggregation of primary particles of amorphous silica with a particle diameter of at least 3 nm and less than 30 nm, and optionally a basic pigment. A protective layer may be formed on the heat-sensitive recording layer.

21 Claims, No Drawings

HEAT-SENSITIVE RECORDING MATERIAL

This application is a 371 of international application PCT/JP2005/022859 filed Dec. 13, 2005, which claims priority based on Japanese patent application No. 2004-376330 filed Dec. 27, 2004, which is incorporated herein by reference.

TECHNICAL FIELD

The present invention relates to a heat-sensitive recording material using the color-forming reaction between a leuco dye and a developer.

BACKGROUND ART

Heat-sensitive recording materials are well-known, which utilize the color-forming reaction between a leuco dye and a developer to produce recorded images by heating. Such heat-sensitive recording materials are relatively inexpensive, and the recording apparatuses therefor are compact and easily maintained. Heat-sensitive recording materials have, therefore, found a wide range of uses: they are used not only as recording media for the output of facsimiles and a variety of computers, printers of scientific measuring equipment, etc., but also as recording media for a variety of printers of POS labels, ATMs, CAD, handy terminals, paper for various tickets, etc.

Heat-sensitive recording materials develop color when a leuco dye and a developer melt by heat and come into contact with each other; therefore, sticking is likely to occur, i.e., a phenomenon in which components of the heat-sensitive recording material that has been melted by heat adhere to the thermal head, and the adhered portion is removed as a result of forcible conveyance by a feed roll.

There is a well-known method for solving such sticking problems, which comprises adding to the heat-sensitive recording layer calcium carbonate, clay, talc, urea-formalin resin, amorphous silica or like oil-absorbing filler (see Nonpatent Document 1).

Among such fillers, amorphous silica is especially preferable, because it has high oil absorption, and imparts to heat-sensitive recording materials high degrees of brightness. Examples of proposed recording layers comprising amorphous silica are as follows: a recording layer comprising amorphous silica having a considerably large primary particle diameter, which is 30 nm or more, while having a remarkably small secondary particle diameter, which is 200 to 1,000 nm (see Patent Document 1); a recording layer comprising powdered silicic acid (see Patent Document 2); a recording layer comprising fine particles of silica whose surfaces have been made spherical (see Patent Document 3); a recording layer comprising amorphous silica having a specific oil absorption (see Patent Document 4); a recording layer comprising amorphous silica having an average secondary particle diameter of 3 to 10 μm and a specified oil absorption (see Patent Document 5); and a recording layer comprising amorphous silica (see Patent Document 6). However, further improvements in recording layers are demanded in terms of recording density and the suppression of undesired color development due to sticking or scratching.

Moreover, heat-sensitive recording materials have been proposed which include a heat-sensitive recording layer containing colloidal particles of amorphous silica referred to as "colloidal silica" (substantially composed of primary particles and substantially free from secondary particles that are agglomerates of the primary particles) (see Patent Document 7 and 8). However, further improvements are demanded in terms of recording density and the suppression of sticking.

Nonpatent Document 1: Takashi Shiga, "*Kami Parupu Technique Times*" (Paper Pulp Technique Times), 27 (8), 34 (1984)

Patent Document 1: Japanese Unexamined Patent Application Publication No. 1984-22794

Patent Document 2: Japanese Unexamined Patent Application Publication No. 1984-26292

Patent Document 3: Japanese Unexamined Patent Application Publication No. 1987-176878

Patent Document 4: Japanese Unexamined Patent Application Publication No. 1995-76172

Patent Document 5: Japanese Unexamined Patent Application Publication No. 1996-310132

Patent Document 6: Japanese Unexamined Patent Application Publication No. 2003-11519

Patent Document 7: Japanese Unexamined Patent Application Publication No. 1993-294065

Patent Document 8: Japanese Unexamined Patent Application Publication No. 2004-25775

DISCLOSURE OF THE INVENTION

Problem to be Solved by the Invention

An object of the invention is to provide a heat-sensitive recording material that is unlikely to have undesired color development, particularly due to sticking or scratching, while exhibiting high recording sensitivity.

Means for Solving the Problem

The inventors conducted extensive research to obtain the following findings:

(a) when amorphous silica having a specific primary particle diameter and a specific average particle diameter of secondary particles is used in a heat-sensitive recording layer, the resulting heat-sensitive recording material is unlikely to have undesired color development due to sticking or scratching, while exhibiting high recording sensitivity.

(b) the heat-sensitive recording layer, when further comprising a basic pigment, reduces background fogging and undesired color development caused by scratching, and is preferable.

(c) when the heat-sensitive recording layer further has thereon a protective layer comprising a binder and amorphous silica having a specific primary particle diameter and a specific average particle diameter of secondary particles, the resulting heat-sensitive recording material exhibits excellent adhesion with printing ink, barrier properties, recording density, anti-sticking properties and anti-scratching properties.

The present invention was accomplished as a result of further research based on these findings. In accordance with the invention, heat-sensitive recording materials as set forth below are provided.

Item 1: A heat-sensitive recording material comprising a support, and a heat-sensitive recording layer that comprises at least a leuco dye, a developer, a binder and a pigment; the pigment in the heat-sensitive recording layer being secondary particles with an average particle diameter of 30 to 900 nm formed by aggregation of amorphous silica primary particles with a particle diameter of at least 3 nm and less than 30 nm.

Item 2: A heat-sensitive recording material according to Item 1, wherein the pigment is composed of secondary particles with an average particle diameter of 50 to 500 nm formed by aggregation of amorphous silica primary particles with a particle diameter of 5 to 27 nm.

Item 3: A heat-sensitive recording material according to Item 1 or 2, wherein the heat-sensitive recording layer further comprises a basic pigment.

Item 4: A heat-sensitive recording material according to Item 3, wherein the basic pigment is at least one member selected from the group consisting of magnesium carbonate, magnesium silicate, light calcium carbonate, ground calcium carbonate and aluminum hydroxide.

Item 5: A heat-sensitive recording material according to Item 1 or 2, wherein the secondary particles are present in a proportion of 1 to 35 mass % relative to total solids of the heat-sensitive recording layer.

Item 6: A heat-sensitive recording material according to Item 3 or 4, wherein the basic pigment is present in a proportion of 1 to 15 mass % relative to total solids of the heat-sensitive recording layer.

Item 7: A heat-sensitive recording material according to Item 1 or 2, wherein the pH of a 5 mass % aqueous dispersion of the secondary particles is from 5.5 to 10.0.

Item 8: A heat-sensitive recording material according to any of Items 1 to 6, wherein the binder is a polyvinyl alcohol or a modified polyvinyl alcohol.

Item 9: A heat-sensitive recording material according to Item 8, wherein the binder is acetoacetyl-modified polyvinyl alcohol.

Item 10: A heat-sensitive recording material according to any of Items 1 to 9, further comprising an undercoat layer between the support and the heat-sensitive recording layer.

Item 11: A heat-sensitive recording material according to Items 1 to 9, comprising a printed portion on the heat-sensitive recording layer.

Item 12: A heat-sensitive recording material according to any of Items 1 to 11, further comprising a protective layer on the heat-sensitive recording layer.

Item 13: A heat-sensitive recording material according Item 12, wherein the protective layer comprises a pigment and a binder; the pigment being secondary particles with an average particle diameter of 30 to 900 nm formed by aggregation of amorphous silica primary particles with a particle diameter of 3 to 70 nm.

Item 14: A heat-sensitive recording material according to Item 13, wherein the secondary particles are present in a proportion of 1 to 40 mass % relative to total solids of the protective layer.

Item 15: A heat-sensitive recording material according to Item 13, wherein the protective layer further comprises at least one pigment selected from the group consisting of kaolin, light calcium carbonate, ground calcium carbonate, calcined kaolin, titanium oxide, magnesium carbonate, aluminum hydroxide, colloidal silica, synthetic layered mica, and plastic pigments such as urea-formalin resin fillers and the like.

Item 16: A heat-sensitive recording material according to Item 13, wherein the binder in the protective layer is an acrylic resin, the acrylic resin being present in a proportion of 10 to 70 mass % relative to total solids of the protective layer.

Item 17: A heat-sensitive recording material according to Item 16, wherein the acrylic resin is a copolymer of (a) (meth)acrylonitrile and (b) a vinyl monomer copolymerizable with (meth)acrylonitrile.

Item 18: A heat-sensitive recording material according to Item 16, wherein the acrylic resin is a copolymer of (xi) at least one monomer selected from the group consisting of acrylonitrile and methacrylonitrile, and (iii) at least one monomer selected from the group consisting of alkyl or hydroxyalkyl esters of acrylic acid and methacrylic acid;

the copolymer having a glass transition temperature Tg of −10 to 100° C.; or a copolymer of (xi) at least one monomer selected from the group consisting of acrylonitrile and methacrylonitrile, (iii) at least one monomer selected from the group consisting of alkyl or hydroxyalkyl esters of acrylic acid and methacrylic acid, (i) at least one monomer selected from the group consisting of acrylic acid and methacrylic acid, and (vi) at least one monomer selected from the group consisting of acrylamide, methacrylamide, N-methylolacrylamide, N-methylolmethacrylamide, and like acrylamide compounds;

the copolymer having a glass transition temperature Tg of 30 to 100° C.

Item 19: A heat-sensitive recording material according to any of Items 16 to 18, wherein the protective layer further comprises a water-soluble resin.

Item 20: A heat-sensitive recording material according to Item 19, wherein the water-soluble resin is a polyvinyl alcohol or a modified polyvinyl alcohol, the polyvinyl alcohol or modified polyvinyl alcohol being present in a proportion of 25 to 600 mass % based on total solids of the acrylic resin.

Item 21: A heat-sensitive recording material according to Item 19, wherein the water-soluble resin is acetoacetyl-modified polyvinyl alcohol with a polymerization degree of 500 to 5,000.

Item 22: A heat-sensitive recording material according to Item 19, wherein the water-soluble resin is diacetone-modified polyvinyl alcohol.

Item 23: A heat-sensitive recording material according to any of Items 12 to 22, further comprising an undercoat layer between the support and the heat-sensitive recording layer.

Item 24: A heat-sensitive recording material according to any of Items 12 to 23, comprising a printed portion on the protective layer.

Effects of the Invention

The heat-sensitive recording material according to the invention is unlikely to have undesired color development, particularly due to sticking or scratching, while exhibiting high recording sensitivity.

Moreover, the heat-sensitive recording material of the present invention, even when having a printed portion on the heat-sensitive recording layer or protective layer, exhibits reduced sticking phenomenon and less reduction in recording sensitivity. More specifically, in recent years, heat-sensitive recording materials have frequently been used as paper for tickets and the like when printed. However, printing conventional heat-sensitive recording materials with ultraviolet curable ink causes the following problems:

(a) low adhesion of ink to the heat-sensitive recording materials causes printed surfaces to be easily removed by, for example, cellophane tape;

(b) when recording is carried out on a printed portion with a thermal head, ink melts by heat and adheres to the thermal head, thereby easily causing a sticking phenomenon; and (c) the thickness of an ink layer printed on the surface of the heat-sensitive recording layer or protective layer of a heat-sensitive recording material attenuates recording energy from the thermal head, resulting in lowered recording sensitivity.

The present invention has the advantage of reducing these problems.

BEST MODE FOR CARRYING OUT THE INVENTION

The present invention will be described in detail below.

In accordance with a preferred embodiment of the invention, a heat-sensitive recording material is provided which comprises a support and a heat-sensitive recording layer formed thereon and comprising at least a leuco dye and a developer, the heat-sensitive recording layer comprising secondary particles with an average particle diameter of 30 to 900 nm formed by aggregation of amorphous silica primary particles with a particle diameter of at least 3 nm and less than 30 nm.

The heat-sensitive recording layer comprises, in addition to the above-defined silica secondary particles, a binder, a leuco dye, and a developer that are known, and optionally a sensitizer, various auxiliaries and the like.

Silica Secondary Particles

The heat-sensitive recording layer according to the invention includes secondary particles with the above-specified average particle diameter that are formed by aggregation of amorphous silica primary particles with the above-specified particle diameter, and thereby melted components from the heat-sensitive recording material is absorbed rapidly and in a large amount, with the result that sticking is suppressed. Moreover, controlling the particle diameter as described above provides advantages in that scratching is unlikely to occur, and the recording sensitivity is improved owing to high transparency.

The secondary particles with an average particle diameter of 30 to 900 nm formed by aggregation of amorphous silica primary particles with a particle diameter of at least 3 nm and less than 30 nm may be produced by any suitable method. Non-limiting examples of such methods include a method of pulverizing by a mechanical means commercially available synthetic amorphous silica or like massive raw material, or pulverizing by a mechanical means a precipitate formed by a chemical reaction (e.g, sedimentation, gel process) in the liquid phase, such as, for example, a neutralization reaction between sodium silicate and a mineral acid; the sol-gel process via the hydrolysis of metal alkoxide; and high-temperature hydrolysis in the gas phase. Examples of the mechanical means include the use of ultrasonic mill, high-speed rotation mill, roller mill, ball mill, media-agitating mill, jet mill, sand grinder, Media-less Ultra-atomization technology devices and the like. In the case of mechanical pulverization, pulverization is preferably performed in water to make an aqueous silica dispersion.

The amorphous silica primary particles for use in the invention have a particle diameter of at least 3 nm and less than 30 nm, particularly from 3 to 29 nm, preferably from 5 to 27 nm, and more preferably from 7 to 25 nm.

The primary particle diameter Dp can be determined according to the following equations:

$$Asp(\mathrm{m}^2/\mathrm{g})=SA\times \mathrm{n} \quad (1)$$

where Asp represents the specific surface area, SA represents the surface area of a single primary particle, and n represents the number of primary particles per 1 g; and $$Dp(\mathrm{nm})=3000/Asp \quad (2)$$

where Dp represents the primary particle diameter, and Asp represents the specific surface area.

Equation (2) is derived based on the assumption that the silica has a spherical shape, and the density of the silica is $d=2(\mathrm{g/cm}^3)$.

More specifically, the method of deriving the primary particle diameter Dp is as follows. The specific surface area Asp can be determined by specific surface area/(volume×density), wherein the unit of density is $\mathrm{g/cm}^3$. When it is assumed that the primary particle has a spherical shape and a diameter of Dp (nm), the surface area of the primary particle is given by $4\pi(Dp/2)^2$, and the volume is given by $(1/3)\times 4\pi(Dp/2)^3$; accordingly, specific surface area $Asp=6/(Dp\times d)$. Now assuming that the density of silica is $d=2\ (\mathrm{g/cm}^3)$ based on its general value, $Asp\ (\mathrm{m}^2/\mathrm{g})=6/(Dp\times 10^{-9}\times 2\times 10^6)=3000/Dp$. Accordingly, the primary particle diameter Dp (nm)=3000/Asp, that is, the diameter can be given in accordance with Equation (2) shown above.

The specific surface area denotes the surface area of amorphous silica per mass. As can be seen from Equation (2), the greater the value of the specific surface area is, the smaller the primary particle diameter is. As the primary particle diameter becomes smaller, the pores formed from the primary particles decrease, thus resulting in higher capillary pressure. Consequently the melted components from the heat-sensitive recording material is believed to be absorbed rapidly for this reason, resulting in reduced sticking. The secondary particles formed from the primary particles becomes complex, thus ensuring a volume that can sufficiently absorb the melted component. A primary particle diameter of less than 3 nm may cause sticking, probably because the pores formed from such primary particles are too small for the melted component from a heat-sensitive recording material to be absorbed therein. Conversely, a primary particle diameter of over 30 nm may also cause sticking, probably because the capillary pressure decreases, thus preventing the melted components from a heat-sensitive recording material from being rapidly absorbed.

The term "melted component" as used herein denotes a melt formed when components in the heat-sensitive recording layer melt during recording. When a printed portion is present on the heat-sensitive recording layer, the term also includes a melt that is formed when the printing ink of the printed portion melts.

The specific surface area of amorphous silica used herein was determined by drying a fine pigment (i.e., the amorphous silica used in the invention) at 105° C., and then measuring the nitrogen absorption-desorption isotherm of the resulting powder sample with a specific surface area measuring apparatus ("SA3100", manufactured by Coulter) after vacuum degassing at 200° C. for 2 hours, and calculating the specific surface area (BET specific surface area) using the gas absorption/desorption method by the reference constant volume method.

In this way, the particle diameter of the amorphous silica primary particles for use in the invention is determined in accordance with Equation (2), using the value of the specific surface area actually measured with the aforementioned specific surface area measuring apparatus ("SA3100" manufactured by Coulter).

The secondary particles have an average particle diameter of 30 to 900 nm, preferably 40 to 700 nm, and more preferably 50 to 500 nm, and particularly 50 to 450 nm. An average particle diameter of less than 30 nm may cause sticking, because the pores formed from such secondary particles are too small for the melted component from a heat-sensitive recording material to be absorbed therein. Conversely, an average particle diameter of over 900 nm may cause the transparency to decrease, resulting in lowered recording sensitivity and reduced strength of a coating layer.

The average particle diameter of secondary particles used herein was determined as follows. The aqueous silica dispersion obtained by the method described above was adjusted to a solids content of 5 mass %. The dispersion was then stirred and dispersed using a homomixer at 5,000 rpm for 30 minutes, and was immediately applied over a hydrophilicated polyester film in an amount of about 3 g/m$^2$ on a dry weight basis, and dried for use as a sample. The sample was observed with electron microscopes (SEM and TEM), and then electron micrographs of the sample were taken at a magnification of 10,000 to 400,000. The Martin's diameters of the secondary particles in a 5-cm square of the electron micrographs were determined, and the average of the Martin's diameters was calculated (see "*Biryushi handbook* (Handbook for Fine Particles)", Asakura Publishing, 1991, p. 52).

The above-described process of stirring and dispersing the dispersion with a homomixer is performed in order just to uniformly disperse the particles for improving measurement accuracy; this is not considered to practically change the size of the secondary particles.

The proportion of amorphous silica secondary particles to total solids of the heat-sensitive recording layer is preferably from 1 to 35 mass %, and more preferably from 1.5 to 30 mass %. At less than 1 mass %, the desired effects cannot be readily obtained, whereas at over 35 mass %, the ability to absorb solvents and the like greatly increases, resulting in lowered barrier properties against solvents.

The 5 mass % dispersion of the secondary particles for use in the heat-sensitive recording layer preferably has a pH of 5.5 to 10.0, and more preferably 6.0 to 9.5. At less than a pH of 5.5, the leuco dye may become colored, resulting in the so-called background fogging. Conversely, at a pH of over 10.0, the color-forming ability may be damaged, resulting in lowered recording sensitivity. Silica secondary particles with the aforementioned range of pHs are known.

Other Pigments

The heat-sensitive recording layer may include other known pigments that are conventionally used in heat-sensitive recording layers of heat-sensitive recording materials, so long as the desired effects of the invention are not impaired. Examples of such other pigments include kaolin, light calcium carbonate, ground calcium carbonate, calcined kaolin, titanium oxide, magnesium carbonate, aluminum hydroxide, colloidal silica, urea-formalin resin fillers, plastic pigments and the like. Moreover, magnesium silicate is also usable. Among such examples, basic pigments are preferable, and in particular, pigments selected from the group consisting of magnesium carbonate, light calcium carbonate, ground calcium carbonate and aluminum hydroxide, as well as magnesium silicate, are preferably used, because they are capable of reducing background fogging and inhibiting undesired color development caused by scratching.

When a basic pigment is used, the basic pigment is added in a proportion of about 1 to about 15 mass %, and more preferably about 5 to about 12 mass %, relative to total solids of the heat-sensitive recording layer. Within the range of 1 to 15 mass %, background fogging and scratching can be reduced to a considerable extent, while the recording sensitivity is satisfactory.

While any basic pigments used in the art are usable, the basic pigment typically has an average particle diameter of 0.1 to 5 μm, and preferably 0.1 to 3 μm. The average particle diameter of the basic pigment is a 50 percent value determined by a laser diffraction particle size distribution analyzer (product name: "SALD 2000", product of Shimadzu Seisakusho Co.).

Binder

Examples of binders for use in the heat-sensitive recording layer include polyvinyl alcohols of various molecular weights, modified polyvinyl alcohols, starch and derivatives thereof, methoxycellulose, carboxymethylcellulose, methylcellulose, ethylcellulose and like cellulose derivatives, sodium polyacrylate, polyvinyl pyrrolidone, acrylamide-acrylic acid ester copolymers, acrylamide-acrylic acid ester-methacrylic acid terpolymers, styrene-maleic anhydride copolymer alkali salts, polyacrylamides, sodium alginate, gelatin, casein and like water-soluble polymeric materials, polyvinyl acetates, polyurethanes, styrene-butadiene copolymers, polyacrylic acid, polyacrylic acid esters, vinyl chloride-vinyl acetate copolymers, polybutyl methacrylate, ethylene-vinyl acetate copolymers, styrene-butadiene-acrylic copolymers and like hydrophobic polymer latexes, etc. Such binders may be used singly or in combination.

Among such examples, polyvinyl alcohols of various molecular weights and modified polyvinyl alcohols are preferably used, because they impart excellent coating layer strength and improved recording sensitivity. The modified polyvinyl alcohol may be, for example, acetoacetyl-modified polyvinyl alcohol with a polymerization degree of 500 to 5,000, and particularly 700 to 4,500; diacetone-modified polyvinyl alcohol with a polymerization degree of 500 to 3,000, and particularly 700 to 3,000; or silyl-modified polyvinyl alcohol with a polymerization degree of 300 to 3,500, and particularly 500 to 2,000.

The content of the binder, a polyvinyl alcohol in particular, based on total solids of the heat-sensitive recording layer is preferably from 5 to 20 mass %, and more preferably 6 to 18 mass %. At less than 5 mass %, the coating layer strength may become insufficient, whereas at over 20 mass %, the recording sensitivity may be lowered.

Leuco Dye

Such leuco dyes can be used singly or in combination. Examples of preferable leuco dyes include triphenylmethane-, fluoran-, phenothiazine-, auramine-, spiropyran-, and indolylphthalide-based leuco dyes. Such leuco dyes may be used singly or in combination. Specific examples of leuco dyes include 3-(4-diethylamino-2-ethoxyphenyl)-3-(1-ethyl-2-methylindol-3-yl)-4-azaphthalide, Crystal violet lactone, 3-(N-ethyl-N-isopentylamino)-6-methyl-7-anilinofluoran, 3-diethylamino-6-methyl-7-anilinofluoran, 3-diethylamino-6-methyl-7-(o,p-dimethylanilino)fluoran, 3-(N-ethyl-N-p-toluidino)-6-methyl-7-anilinofluoran, 3-(N-ethyl-p-toluidino)-6-methyl-7-(p-toluidino)fluoran, 3-pyrrolidino-6-methyl-7-anilinofluoran, 3-di(N-butyl)amino-6-methyl-7-anilinofluoran, 3-di(N-butyl)amino-7-(o-chloroanilino)fluoran, 3-di(N-pentyl)amino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofluoran, 3-diethylamino-6-methylfluoran, 3-cyclohexylamino-6-chlorofluoran, 3-(N-ethyl-N-hexylamino)-6-methyl-7-(p-chloroanilino)fluoran, 3,6-bis(dimethylamino)fluorene-9-spiro-3'-(6'-dimethylamino)phthalide, etc.

Developer

Such developers can be used singly or in combination. Specific examples of developers include 4-hydroxy-4'-isopropoxydiphenylsulfone, 4-hydroxy-4'-allyloxydiphenylsulfone, 4,4'-isopropylidenediphenol, 4,4'-cyclohexylidenediphenol, 2,2-bis(4-hydroxyphenyl)-4-methylpentane, 2,4'-dihydroxydiphenylsulfone, 4,4'-dihydroxydiphenylsulfone, 3,3'-diallyl-4,4'-dihydroxydiphenylsulfone, 4-hydroxy-4'-methyldiphenylsulfone, 1,1-bis(4-hydroxyphenyl)-1-phenylethane, 1,4-bis[α-methyl-α-(4'-hydroxyphenyl)ethyl]benzene and like phenolic compounds; N-p-tolylsulfonyl-N'-phenylurea, 4,4'-bis[(4-methyl-3-phenoxycarbonylaminophenyl)ureido]diphenylmethane, N-p-tolylsulfonyl-N'-p-butoxyphenylurea and like compounds having sulfonyl group(s) and/or ureido group(s); zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate and like aromatic carboxylic acid zinc salts; etc.

Sensitizer

In accordance with the invention, the heat-sensitive recording layer may optionally include a sensitizer. Such sensitizers can be used singly or in combination. Specific examples of sensitizers include stearic acid amide, stearic acid methylene bisamide, stearic acid ethylene bisamide, 4-benzylbiphenyl, p-tolylbiphenyl ether, di(p-methoxyphenoxyethyl)ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, 2-naphthyl benzyl ether, 1-(2-naphthyloxy)-2-phenoxyethane, 1,3-di(naphthyloxy)propane, dibenzyl oxalate, di-p-methyl-benzyl oxalate, di-p-chlorobenzyl oxalate, dibutyl terephthalate, dibenzyl terephthalate, 2-(2'-hydroxy-5'-methylphenyl)benzotriazole, etc.

In addition to the above, various known auxiliaries may be used, such as lubricants (e.g., zinc stearate, calcium stearate, polyethylene wax, polyolefin resin emulsions and the like), anti-foaming agents, wetting agents, preservatives, fluorescent brighteners, dispersing agents, thickeners, colorants, antistatic agents, cross-linking agents, etc.

Heat-Sensitive Recording Layer According to the Invention

The heat-sensitive recording layer for use in the heat-sensitive recording material of the invention can be prepared by a generally known method. For example, a leuco dye and a developer are separately pulverized and dispersed together with an aqueous binder solution using a disperser such as a ball mill, and then mixed and stirred with the above specified silica secondary particles, optionally together with a sensitizer and various auxiliaries, to thereby prepare a heat-sensitive recording layer coating composition. The heat-sensitive recording layer coating composition is then applied over the support and dried by a known method.

In the heat-sensitive recording layer of the invention, the content of the leuco dye in a heat-sensitive coloring layer is typically from 5 to 20 mass %. The content of the developer in the heat-sensitive coloring layer is typically from 5 to 40 mass %. When a sensitizer is included, the content of the sensitizer in the heat-sensitive coloring layer is preferably from 10 to 40 mass %. A lubricant is preferably contained in the heat-sensitive coloring layer in an amount of 5 to 20 mass %.

Support

The support for use in the heat-sensitive recording material of the invention can be selected from papers, coated papers in which paper surfaces are coated with pigments, latex and the like, multilayered synthetic papers made from polyolefin-based resins, plastic films, and composite sheets thereof.

Undercoat Layer

In accordance with the invention, an undercoat layer may optionally be provided between the support and the heat-sensitive recording layer to further improve recording sensitivity and recording runnability.

The undercoat layer can be formed by applying over the support an undercoat layer coating composition that principally comprises a binder and at least one member selected from the group consisting of organic hollow particles, thermal-expansion particles, and oil-absorbing pigments having an oil absorption of 70 mL/100 g or more, and preferably from about 80 to about 150 mL/100 g, and then drying the coating composition. The oil absorption is herein determined in accordance with JIS K 5101-1991.

While a variety of oil-absorbing pigments are usable, specific examples include inorganic pigments such as calcined clay, calcined kaolin, amorphous silica, light calcium carbonate, talc, etc. Such oil-absorbing pigments preferably have an average particle diameter of about 0.01 to about 5 μm, and particularly about 0.02 to about 3 μm. The average particle diameter is a 50 percent value determined by a laser diffraction particle size distribution analyzer (trade name: "SALD 2000", manufactured by Shimadzu Seisakusho Co.).

The amount of oil-absorbing pigment used can be selected from a broad range, but is typically from about 2 to about 95 mass %, and preferably from about 5 to about 90 mass %, of total solids of the undercoat layer.

Known organic hollow particles are usable, and examples include particles having a void ratio of from about 50 to about 99%, whose shells are made of acrylic resin, styrene resin, vinylidene chloride resin and the like. The void ratio is herein determined by $(d/D)\times 100$, wherein d represents the inside diameter of, and D represents the outside diameter of, organic hollow particles. The organic hollow particles for use in the invention preferably have an average particle diameter of about 0.5 to about 10 μm, and particularly about 1 to about 3 μm. The average particle diameter is a 50 percent value determined by a laser diffraction particle size distribution analyzer (trade name: "SALD 2000", manufactured by Shimadzu Seisakusho Co.).

The amount of organic hollow particles used can be selected from a broad range, but is typically from about 2 to about 90 mass %, and preferably from about 5 to about 70 mass %, based on total solids of the undercoat layer.

When an oil-absorbing inorganic pigment is used together with organic hollow particles, the oil-absorbing inorganic pigment and the organic hollow particles are each preferably used in the aforementioned range; the total content of the oil-absorbing inorganic pigment and the organic hollow particles is preferably from about 5 to about 90 mass %, and more preferably from about 10 to about 80 mass %, based on total solids of the undercoat layer.

While a variety of thermal-expansion particles are usable, specific examples include thermal-expansion fine particles obtained by microencapsulation of low-boiling hydrocarbons with copolymers, such as vinylidene chloride, acrylonitrile, etc., by in-situ polymerization. Examples of low-boiling hydrocarbons include ethane, propane, etc.

The amount of thermal-expansion particles used can be selected from a broad range, but is typically from about 1 to about 80 mass %, and preferably from about 10 to about 70 mass %, based on total solids of the undercoat layer.

While the aforementioned binders for use in the heat-sensitive recording layer are suitable for use, preferable binders are starch-vinyl acetate graft copolymer, various polyvinyl alcohols, and styrene-butadiene copolymer latex.

Examples of polyvinyl alcohols include completely saponified polyvinyl alcohols, partially saponified polyvinyl alcohols, carboxy-modified polyvinyl alcohol, acetoacetyl-modified polyvinyl alcohol, diacetone-modified polyvinyl alcohol, silicon-modified polyvinyl alcohol, etc.

The amount of the binder used can be selected from a broad range, but is typically from about 5 to about 30 mass %, and preferably from about 10 to about 25 mass %, based on total solids of the undercoat layer.

In addition to the above, various known auxiliaries such as lubricants, anti-foaming agents, wetting agents, preservatives, fluorescent brighteners, dispersing agents, thickeners, colorants, antistatic agents, cross-linking agents, etc. can be used.

The undercoat layer may be applied in an amount of about 3 to about 20 g/m$^2$, and preferably about 5 to about 12 g/m$^2$, on a dry weight basis.

The undercoat layer can be applied by any known coating technique such as, for example, air-knife coating, vari-bar blade coating, pure blade coating, gravure coating, rod blade coating, short-dwell coating, curtain coating, die coating, etc.

Protective Layer

The heat-sensitive recording material of the invention may not necessarily include a protective layer, but may optionally have a protective layer on the heat-sensitive recording layer. The protective layer may comprise a known pigment, binder, various auxiliaries and the like.

While various types of protective layers are usable, a protective layer may be preferably used which comprises a pigment, a binder, and optionally other components that will be described below. Heat-sensitive recording materials comprising such protective layers exhibit excellent adhesion with printing ink, barrier properties, recording density, anti-sticking properties and anti-scratching properties.

<Pigment>

In the heat-sensitive recording material of the present invention, the protective layer formed on the heat-sensitive recording layer preferably comprises amorphous silica and a binder as principal components. Amorphous silica, in general, is composed of secondary particles formed by aggregation of the primary particles. The primary particle diameter and the average particle diameter of secondary particles are not limited, and may be selected from a broad range. For example, the primary particle diameter can be selected from the range of about 3 to about 70 nm; and the average particle diameter of secondary particles formed by aggregation of the primary particles can be selected from the range of about 30 to about 5,000 nm.

In accordance with a further preferred embodiment of the invention, the pigment for use in the protective layer is preferably composed of secondary particles with an average particle diameter of 30 to 900 nm that are formed by amorphous silica primary particles with a particle diameter of 3 to 70 nm. The protective layer according to this further preferred embodiment will be described below.

The protective layer of the invention comprises secondary particles with the aforementioned specific average particle diameter formed by aggregation of amorphous silica primary particles. This provides excellent printing-ink adhesion with the protective layer (i.e., ink fastness), and prevents the adhesion of ink to the thermal head, because the protective layer absorbs printing-ink component melted during recording at a printed portion with the thermal head, thereby reducing sticking. Another advantage thereof is improved recording sensitivity due to high transparency.

The secondary particles having an average particle diameter of 30 to 900 nm formed by aggregation of amorphous silica primary particles with a particle diameter of 3 to 70 nm for use in the protective layer may be produced by any suitable method. Examples of non-limiting methods include a method of mechanically pulverizing commercially available synthetic amorphous silica or a like massive raw material, or mechanically pulverizing a precipitate or the like formed by chemical reaction in the liquid phase; the sol-gel process via the hydrolysis of metal alkoxide; high-temperature hydrolysis in the gas phase; and the like. Examples of mechanical means include the use of ultrasonic mill, high-speed rotation mill, roller mill, ball mill, media-agitating mill, jet mill, sand grinder, wet-type Media-less Ultra-atomization technology devices and the like. In the case of mechanical pulverization, pulverization is preferably performed in water to make an aqueous silica dispersion.

The amorphous silica primary particles for use in the protective layer have a particle diameter of 3 to 70 nm, preferably 5 to 50 nm, and more preferably 7 to 40 nm.

As with the silica for use in the heat-sensitive recording layer, the primary particle diameter Dp can also be determined according to the following equation:

$$Dp(\text{nm})=3000/Asp \quad (2)$$

wherein Dp represents the primary particle diameter, and Asp represents the specific surface area.

The specific surface area denotes the surface area of amorphous silica per unit mass (i.e., per 1 g). As can be seen from Equation (2), the greater the value of the specific surface area is, the smaller the primary particle diameter is. As the primary particle diameter becomes smaller, the pores formed from the primary particles (i.e., the pores formed in the secondary particles formed by aggregation of the primary particles) decrease, thus resulting in higher capillary pressure. The melted component is believed to be absorbed rapidly for this reason, resulting in reduced sticking. It is also assumed that the arrangement of secondary particles formed from the primary particles becomes complex, thus ensuring a volume that can sufficiently absorb the melted component. The primary particle diameter is 3 to 70 nm, preferably 5 to 50 nm, and more preferably 7 to 40 nm. The lower the upper limit for the primary particle diameter is, the less the adhesion of residue to the thermal head becomes, and the better the anti-sticking properties becomes.

The term "melted component" denotes a melt formed when components in the protective layer melt during recording. When a printed portion is present on the protective layer, the term also includes a melt that is formed when the printing ink of the printed portion melts.

The specific surface area of amorphous silica used herein was determined by drying a fine pigment (i.e., the amorphous silica used in the invention) at 105° C., and then measuring the nitrogen absorption-desorption isotherm of the resulting powder sample with a specific surface area measuring apparatus ("SA3100", manufactured by Coulter) after vacuum degassing at 200° C. for 2 hours, and calculating the BET specific surface area.

In this way, the particle diameter of the amorphous silica primary particles for use in the invention was determined by actually measuring the specific surface area using the aforementioned specific surface area measuring apparatus ("SA3100" manufactured by Coulter), and then calculating the particle diameter in accordance with Equation (2).

The average particle diameter of the secondary particles is from 30 to 900 nm, preferably from 40 to 700 nm, and more preferably from 50 to 500 nm. Secondary particles with an average particle diameter of less than 30 nm are not only difficult to make, but also form pores whose volume is too small for the fused ink component to penetrate through, resulting in a risk of sticking. Conversely, secondary particles with an average particle diameter of more than 900 nm may result in lowered transparency, lowered recording sensitivity and/or lowered barrier properties.

The average particle diameter of secondary particles used herein was determined as follows. The aqueous silica dispersion obtained by the method described above was adjusted to a solids content of 5 mass %. The dispersion was then stirred and dispersed using a homomixer at 5,000 rpm for 30 minutes, and was immediately applied over a hydrophilicated polyester film in an amount of about 3 g/m$^2$ on a dry weight basis, and dried for use as a sample. The sample was observed with electron microscopes (SEM and TEM), and then electron micrographs of the sample were taken at a magnification of 10,000 to 400,000. The Martin's diameters of the secondary particles in a 5-cm square of the electron micrographs were determined, and the average of the Martin's diameters was calculated (see "*Biryushi handbook* (Handbook for Fine Particles)", Asakura Publishing, 1991, p. 52).

The above-described process of stirring and dispersing the dispersion with a homomixer was performed in order just to uniformly disperse the particles for improving measurement accuracy; this is not considered to practically change the size of the secondary particles.

The content of the secondary particles in the protective layer is preferably from about 1 to about 40 mass %, and more preferably from about 2.5 to about 30 mass %, based on total solids of the protective layer. Within the range of 1 to 40 mass %, the aforementioned desired effects, especially excellent oil resistance and plasticizer resistance, can be readily attained.

The protective layer of the invention may include other known pigments, as necessary, so long as the desired effects of the invention are not impaired. Examples of such pigments include kaolin, light calcium carbonate, ground calcium carbonate, calcined kaolin, titanium oxide, magnesium carbonate, aluminum hydroxide, colloidal silica, synthetic layered mica, plastic pigments such as urea-formalin resin fillers and the like.

Note that colloidal silica is substantially composed of primary particles, and is substantially free from secondary particles that are agglomerates of the primary particles.

The pigment has an average particle diameter of about 0.1 to about 5 μm, and preferably about 0.1 to about 3 μm. The average particle diameter of the pigment is a 50 percent value determined by a laser diffraction particle size distribution analyzer (product name: "SALD 2000", product of Shimadzu Seisakusho Co.).

When any of such other pigments is used, the pigment is added in an amount of from about 0 to about 40 mass %, and preferably from about 0 to about 35 mass %, based on total solids of the protective layer.

Binder

The protective layer comprises a binder in addition to the pigment described above. While a variety of binders used in protective layers of heat-sensitive recording materials are usable, an acrylic resin is especially preferable for use as a binder in the invention.

An acrylic resin that is used as a binder in the protective layer has good adhesion especially with ultraviolet curable ink, and is therefore preferably used. The acrylic resin may be a core-shell type two-layer emulsion or a single-layer emulsion.

Examples of monomer components usable for preparing the acrylic resin include acrylic acid, methacrylic acid, itaconic acid, maleic acid, fumaric acid, crotonic acid, and like ethylenically unsaturated carboxylic acids; styrene, vinyltoluene, vinylbenzene, and like aromatic vinyl compounds; methyl acrylate, ethyl acrylate, hydroxyethyl acrylate, butyl acrylate, 2-ethylhexyl acrylate, octyl acrylate, and like alkyl esters of acrylic acid and methacrylic acid; acrylamide, methacrylamide, N-methylolacrylamide, N-methylolmethacrylamide, and like derivatives of acrylamide and methacrylamide; diacetone acrylamide, glycidyl acrylate, glycidyl methacrylate, vinyl acetate, vinyl chloride, vinylidene chloride, butadiene, acrylonitrile, methacrylonitrile, dimethylaminoethyl methacrylate, trimethylaminoethyl methacrylate, diethylaminoethyl methacrylate, triethylaminoethyl methacrylate, etc.

Specific examples of monomer components usable for preparing the acrylic resin include the following:

(i) acrylic acid and methacrylic acid;

(ii) ethylenically unsaturated monocarboxylic acids such as crotonic acid and the like; ethylenically unsaturated dicarboxylic acids such as itaconic acid, maleic acid, fumaric acid and the like, and monoalkyl esters thereof such as $C_{1-10}$ monoalkyl esters, in particular;

(iii) methyl acrylate, ethyl acrylate, hydroxyethyl acrylate, butyl acrylate, 2-ethylhexyl acrylate, octyl acrylate, and like alkyl or hydroxyalkyl esters of acrylic acid and methacrylic acid ($C_{1-10}$ alkyl or $C_{1-10}$ hydroxyalkyl esters, in particular);

(iv) vinyl esters such as vinyl acetate, vinyl propionate and the like;

(v) aromatic vinyl compounds such as styrene, vinyltoluene, vinylbenzene and the like;

(vi) acrylamide compounds such as acrylamide, methacrylamide, N-methylolacrylamide, N-methylolmethacrylamide and the like;

(vii) heterocyclic vinyl compounds such as vinyl pyrrolidone and the like;

(viii) halogenated vinylidene compounds such as vinylidene chloride, vinylidene fluoride and the like;

(ix) α-olefins such as ethylene, propylene and the like;

(x) dienes such as butadiene and the like;

(xi)(meth)acrylonitrile; and so forth.

The term "(meth)acrylonitrile" as used herein denotes acrylonitrile, methacrylonitrile or a mixture thereof.

Examples of acrylic resins for use in the invention include copolymer resins of at least two monomers selected from the group consisting of monomers (i), (iii), (vi) and (xi); copolymer resins of at least one monomer selected from the group consisting of monomers (i), (iii), (vi) and (xi) and at least one monomer selected from the group consisting of monomers (ii), (iv), (v), (vii), (viii), (ix) and (x); etc. Examples of such copolymer resins include a copolymer resin of acrylic acid and acrylonitrile; a copolymer resin of acrylic acid, acrylonitrile and acrylamide; a copolymer resin of an acrylic acid $C_{1-10}$ alkyl ester and acrylonitrile; a quaterpolymer resin of acrylic acid, acrylonitrile, acrylamide and an acrylic acid $C_{1-10}$ alkyl ester; etc.

Examples of preferred acrylic resins for use in the invention include copolymer resins of monomers (iii) and (xi) (e.g., a copolymer resin of an acrylic acid $C_{1-10}$ alkyl ester and acrylonitrile); and copolymer resins of monomers (i), (iii), (vi) and (xi) (e.g., a quaterpolymer resin of acrylic acid, acrylonitrile, acrylamide and an acrylic acid $C_{1-10}$ ester).

Furthermore, in accordance with a particularly preferred embodiment of the invention, acrylic resins for use as the binder are preferably copolymers of (meth)acrylonitrile and a vinyl monomer copolymerizable with (meth)acrylonitrile, and among such copolymers, those having a glass transition temperature (Tg) of −10 to 100° C., and more specifically 0 to 80° C., are preferred.

The proportion of (meth)acrylonitrile in the copolymer is not limited so long as the effects of the invention can be attained, but is preferably from about 20 to about 80 mass %, and more preferably from about 30 to about 70 mass %.

Examples of vinyl monomers copolymerizable with (meth)acrylonitrile include the monomers (i) to (x) mentioned above. In the copolymer for use in the invention, the proportion of vinyl monomer copolymerizable with (meth) acrylonitrile is not limited so long as the effects of the invention can be attained, but is preferably from about 80 to about 20 mass %, and more preferably from about 70 to about 30 mass %.

The acrylic resin preferably comprises, among vinyl monomers copolymerizable with (meth)acrylonitrile, at least one vinyl monomer containing one or more (preferably one or two) carboxyl groups.

The proportion of the carboxyl group-containing vinyl monomer per total mass of the copolymer resin is preferably from 1 to 10 mass %, and more preferably from 2 to 8 mass %.

Examples of the carboxyl group-containing vinyl monomers include at least one or a combination of monomers selected from the group consisting of monomer (i) (namely, at least one of acrylic acid and methacrylic acid), monomer (ii) (namely, ethylenically unsaturated monocarboxylic acids such as crotonic acid and the like, and ethylenically unsaturated dicarboxylic acids such as itaconic acid, maleic acid, fumaric acid, and the like), and monoalkyl esters ($C_{1-10}$ monoalkyl esters, in particular) of monomers (i) and (ii).

Preferable examples among the carboxyl group-containing vinyl monomers mentioned above are one or a combination of monomers selected from the group consisting of ethylenically unsaturated monocarboxylic acids such as acrylic acid, methacrylic acid, crotonic acid, and the like, ethylenically unsaturated dicarboxylic acids such as itaconic acid, maleic acid, fumaric acid and the like, and monoalkyl esters thereof ($C_{1-10}$ monoalkyl esters, in particular).

Preferable copolymers among those mentioned above are copolymers of (xi) at least one monomer selected from the group consisting of acrylonitrile and methacrylonitrile and (iii) at least one monomer selected from the group consisting of alkyl or hydroxyalkyl esters ($C_{1-10}$ alkyl or $C_{1-10}$ hydroxyalkyl esters, in particular) of acrylic acid and methacrylic acid. Such copolymers preferably have a glass transition temperature Tg of about −10 to about 100° C., and more preferably about 0 to about 80° C. The contents of monomer (xi) and monomer (iii) in the copolymer can be suitably selected from a broad range, but, typically, the content of monomer (xi) is preferably from about 20 to about 80 mass %, more preferably from about 30 to about 70 mass %; and the content of monomer (iii) is preferably from about 80 to about 20 mass %, more preferably from about 70 to about 30 mass %.

Also preferable are copolymers of monomers (xi), (iii), (i) and (vi) shown below:

(xi) at least one member selected from the group consisting of acrylonitrile and methacrylonitrile;

(iii) at least one member selected from the group consisting of alkyl or hydroxyalkyl esters (especially $C_{1-10}$ alkyl or $C_{1-10}$ hydroxyalkyl esters) of acrylic acid and methacrylic acid;

(i) at least one member selected from the group consisting of acrylic acid and methacrylic acid; and (vi) at least one member selected from the group consisting of acrylamide, methacrylamide, N-methylolacrylamide, N-methylolmethacrylamide and like acrylamide compounds.

Among such copolymers of monomers (xi), (iii), (i) and (vi), those having a glass transition temperature Tg of about 30 to about 100° C., and more specifically about 30 to about 70° C., are preferred.

The contents of these monomers in the copolymer can be suitably selected from a broad range, but, for example, the content of monomer (i) is preferably from 1 to 10 mass %, and more preferably from about 2 to about 8 mass %; the content of monomer (iii) is preferably from 1 to 50 mass %, and more preferably from about 2 to about 45 mass %; the content of monomer (vi) is preferably from 1 to 50 mass %, and more preferably from about 2 to about 45 mass %; and the content of monomer (xi) is preferably from 20 to 80 mass %, and more preferably from about 30 to about 70 mass %.

While the amount of acrylic resin used can be suitably selected from a broad range, the proportion of acrylic resin to total solids of the protective layer is preferably from 10 to 70 mass %. Within this range, the resulting heat-sensitive recording material exhibits excellent adhesion especially with ultraviolet curable ink, reduced adhesion of residue to the thermal head, and a reduced possibility of sticking of the printed portion during recording. The proportion of acrylic resin to total solids of the protective layer is more preferably from about 15 to about 60 mass %.

Because acrylic resins may have poor barrier properties against plasticizers and solvents such as oils, the acrylic resin for use in the invention is preferably used together with a water-soluble resin. Examples of water-soluble resins include polyvinyl alcohols, modified polyvinyl alcohols, polyvinyl acetals, polyethyleneimine, polyvinyl pyrrolidone, polyacrylamide, starch and derivatives thereof, cellulose and derivatives thereof, gelatin, casein, etc.

Among such water-soluble resins, polyvinyl alcohols and modified polyvinyl alcohols are preferable, because they exhibit superior binding effects with pigments, while giving the recorded portions excellent durability against plasticizers and solvents such as oils. Particularly preferred are modified polyvinyl alcohols such as acetoacetyl-modified polyvinyl alcohol, carboxy-modified polyvinyl alcohol, diacetone-modified polyvinyl alcohol and the like.

Among such modified polyvinyl alcohols, those that are typically preferable for use are acetoacetyl-modified polyvinyl alcohols having a polymerization degree of about 500 to about 5,000, and more specifically about 700 to about 4,500, and diacetone modified-polyvinyl alcohols having a polymerization degree of about 500 to about 3,000, and more specifically about 700 to about 3,000.

When such a water-soluble resin, in particular, a polyvinyl alcohol or a modified polyvinyl alcohol, is used, the proportion of water-soluble resin to total solids of the acrylic resin is from about 25 to about 600 mass %, preferably from about 25 to about 550 mass %, and more preferably from about 30 to about 500 mass %. Within the range of about 25 to about 600 mass %, a good binder effect, good durability of the recorded portions against solvents, and good ink adhesion can be obtained.

In addition to the above, various known auxiliaries may suitably be added to the protective layer, such as lubricants, anti-foaming agents, wetting agents, preservatives, fluorescent brighteners, dispersing agents, thickeners, colorants, antistatic agents, cross-linking agents and the like.

Heat-Sensitive Recording Material of the Invention

The heat-sensitive recording material according to the invention can be prepared using a commonly known method. For example, when preparing a heat-sensitive recording material in accordance with the invention that comprises a heat-sensitive recording layer, but does not comprise a protective layer, the above-described leuco dye and developer may be separately pulverized and dispersed together with an aqueous binder solution using a disperser such as a ball mill, and then mixed and stirred with the above-identified silica secondary particles, optionally with a sensitizer, a pigment and various auxiliaries, so as to prepare a heat-sensitive recording layer coating composition. The heat-sensitive recording layer coating composition may then be applied and dried by a known method.

When preparing a heat-sensitive recording material in accordance with the invention that comprises a heat-sensitive recording layer and a protective layer, the above-prepared heat-sensitive recording layer coating composition is prepared, and a protective layer coating composition is prepared by mixing the above silica dispersion, an acrylic resin, other binder(s) and various auxiliaries. The heat-sensitive recording layer coating composition and the protective layer coating composition are then applied and dried in this order over the support by a known method.

In either case, the amount of heat-sensitive recording layer coating composition applied on a dry weight basis can be suitably selected from a broad range, but is typically from about 1.5 to about 10 g/m$^2$, and more preferably from about 2 to about 8 g/m$^2$.

The amount of protective layer coating composition applied on a dry weight basis can also suitably be selected from a broad range, but is typically from about 0.2 to about 5 g/m$^2$, and preferably from about 0.3 to about 3.5 g/m$^2$.

As previously described, the heat-sensitive recording material of the invention is especially suitable for use as paper for tickets or the like when printed; it has excellent ink fastness, and reduces sticking of the printed portion to such an extent that substantially or practically no problems arise during recording.

Therefore, the heat-sensitive recording material advantageously has a printed portion formed by printing on the heat-sensitive recording layer or protective layer. Ultraviolet curable ink is preferably used as a printing ink, and printing may be performed by a conventional method.

A variety of known ultraviolet curable inks are available, which typically comprise coloring materials, prepolymers, monomers, photoinitiators and additives. Examples of coloring materials include organic coloring pigments, inorganic coloring pigments, dyes, fluorescent dyes, etc.

Examples of prepolymers include polyol acrylates, epoxy acrylates, urethane acrylates, polyester acrylates, alkyd acrylates, polyether acrylates, etc.

Examples of monomers include monoacrylates, diacrylates, triacrylates, etc.

The photoinitiator for use in the invention may suitably be selected from known photoinitiators depending on the prepolymers and monomers used.

Examples of additives include lubricants, anti-foaming agents, surfactants, etc.

Various types of ultraviolet curable inks containing such components are commercially available from the market. Examples of such inks include the Flash Dry series (manufactured by Toyo Ink Corporation) such as FDS TK series, FDS new series, etc.; BEST CURE series (manufactured by T&K TOKA Company) such as "UV RNC", "UV NVR", "UV STP", etc.; DAI Cure series (manufactured by Dainippon Ink and Chemicals) such as "ABILIO", "SCEPTER", "MUseal", etc.

In accordance with the invention, various techniques known in the field of heat-sensitive recording material preparation can be additionally applied as required. Examples of such techniques include the application of smoothing treatments such as supercalendering after the formation of each or all of the layers; forming on the back surface of the support of the heat-sensitive recording material a protective layer (back coat layer), a coating layer for printing, a magnetic recording layer, an antistatic layer, a thermal transfer recording layer, an ink jet recording layer and/or the like, as necessary; processing the heat-sensitive recording material into an adhesive label by adhesive-processing the rear surface of the support; perforating the heat-sensitive recording material; and so forth. Moreover, the heat-sensitive recording layer of the heat-sensitive recording material can be imparted with a multicolor-recording capability.

EXAMPLES

The present invention will be described in more detail below by way of Examples, which are not intended to limit the invention. In the Examples, "parts" and "%" represent "parts by mass" and "percent by mass", respectively, unless otherwise specified.

The average particle diameter of the silica and the pH of the silica dispersion used in each Example or Comparative Example were measured by the methods described below.

Average Particle Diameter of Secondary Particles

A 5% silica dispersion was stirred and dispersed using a homomixer at 5,000 rpm for 30 minutes. The resulting dispersion was then immediately applied to a film in an amount of about 3 g/m$^2$ on a dry weight basis and dried for use as a sample. The sample was observed with electron microscopes (SEM and TEM), and electron micrographs of the sample were taken at a magnification of 10,000 to 400,000. The Martin's diameters of the secondary particles in a 5-cm square were determined and the average of the Martin's diameters was calculated.

pH Measurement Method

Using a Rucom Tester pH meter (pH Scan WPBN-type, manufactured by As One Corporation), the pH electrode was directly immersed in a silica dispersion to measure the pH of the silica dispersion.

The silica dispersion used in the pH measurement was prepared by diluting the silica dispersion for use in each of the following Examples or Comparative Examples with water to a solids content of 5 mass %.

The pH meter used in the pH measurement was calibrated using calibration solutions conforming to the NIST standards (two types: pH 6.86 and pH 9.18) before the pH measurement was performed.

The silica dispersions used in the Examples and Comparative Examples were prepared as described below.

Note that the "average secondary particle diameter" of commercially available silica used for the preparation of each of Silica Dispersions A to F is the value shown in the manufacturer's catalog, unless otherwise specified.

The "primary particle diameters" of the commercially available silica and the silica dispersion obtained after pulverization and dispersion in each of Silica Dispersions A to F were determined in accordance with Equation (2) shown above, using the value of the specific surface area. The "average particle diameter of secondary particles" of the silica dispersion obtained after pulverization and dispersion was determined by the procedure described in the section "average particle diameter of secondary particles" shown above.

Preparation of Silica Dispersion A

Commercially available silica (trade name: Finesil F80, manufactured by Tokuyama Co., Ltd.; average secondary particle diameter: 1,500 nm; primary particle diameter: 10 nm; specific surface area: 300 m$^2$/g) was dispersed in water and pulverized using a sand grinder. Pulverization and dispersion was then repeated using a Media-less Ultra-atomization technology device (trade name: Nanomizer, manufactured by Yoshida Kikai, Co., Ltd.) to form 10% Silica Dispersion A (pH value=7.5) having a primary particle diameter of 10 nm and an average particle diameter of secondary particles of 100 nm.

Preparation of Silica Dispersion B

Commercially available silica (trade name: Finesil X-45, manufactured by Tokuyama Co., Ltd.; average secondary particle diameter: 4,500 nm; primary particle diameter: 12 nm; specific surface area: 260 $m^2/g$) was dispersed in water and pulverized using a sand grinder. Pulverization and dispersion was then repeated using a Media-less Ultra-atomization technology device (trade name: Nanomizer, manufactured by Yoshida Kikai, Co., Ltd.) to form 10% Silica Dispersion B (pH value=7.5) having a primary particle diameter of 12 nm and an average particle diameter of secondary particles of 300 nm.

Preparation of Silica Dispersion C

Commercially available silica (trade name: Finesil X-45, manufactured by Tokuyama Co., Ltd.; average secondary particle diameter: 4,500 nm; primary particle diameter: 12 nm; specific surface area: 260 $m^2/g$) was dispersed in water using an agitator to form 10% Silica Dispersion C (pH value=7.5) having a primary particle diameter of 12 nm and an average particle diameter of secondary particles of 4,500 nm.

Preparation of Silica Dispersion D

Commercially available silica (trade name: Finesil X-45, manufactured by Tokuyama Co., Ltd.; average secondary particle diameter: 4,500 nm; primary particle diameter: 12 nm; specific surface area: 260 $m^2/g$) was dispersed in water and pulverized using a sand grinder. Pulverization and dispersion was then repeated using a wet-type Media-less Ultra-atomization technology device (trade name: Nanomizer, manufactured by Yoshida Kikai, Co., Ltd.) to form 10% Silica Dispersion D (pH value of 7.5) having a primary particle diameter of 12 nm and an average particle diameter of secondary particles of 900 nm.

Preparation of Silica Dispersion E

Commercially available silica (trade name: Mizukasil P-526, manufactured by Mizusawa Industrial Chemicals, Ltd.; average secondary particle diameter: 3,300 nm; primary particle diameter: 24 nm; specific surface area: 125 $m^2/g$) was dispersed in water and pulverized using a sand grinder. Pulverization and dispersion was then repeated using a Media-less Ultra-atomization technology device (trade name: Nanomizer, manufactured by Yoshida Kikai, Co., Ltd.) to form 10% Silica Dispersion E (pH value of 7.5) having a primary particle diameter of 24 nm and an average particle diameter of secondary particles of 300 nm.

Preparation of Silica Dispersion F

Sample silica (average secondary particle diameter: 4,500 nm; primary particle diameter: 32 nm; specific surface area: 94 $m^2/g$) was dispersed in water and pulverized using a sand grinder. Pulverization and dispersion was then repeated using a Media-less Ultra-atomization technology device (trade name: Nanomizer, manufactured by Yoshida Kikai, Co., Ltd.) to form 10% Silica Dispersion F (pH value=7.5) having a primary particle diameter of 32 nm and an average particle diameter of secondary particles of 300 nm.

Example 1

Preparation of Undercoat Layer Coating Composition

A dispersion of 85 parts of calcined kaolin (trade name: Ansilex, manufactured by Engelhard Corporation) in 320 parts of water was mixed with 40 parts of a styrene-butadiene copolymer emulsion (solids content: 50%) and 50 parts of a 10% aqueous solution of oxidized starch, and the mixture was stirred to give an undercoat layer coating composition.

Preparation of Leuco Dye Dispersion (Dispersion (a))

A composition comprising 10 parts of 3-(N-ethyl-N-isopentylamino)-6-methyl-7-anilinofluoran, 5 parts of a 5% aqueous solution of methylcellulose, and 15 parts of water was pulverized using a sand mill to an average particle diameter of 1.5 μm, thus giving a leuco dye dispersion (Dispersion (a)).

Preparation of Developer Dispersion (Dispersion (b))

A composition comprising 10 parts of 3,3'-diallyl-4,4'-dihydroxydiphenylsulfone, 5 parts of a 5% aqueous solution of methylcellulose, and 15 parts of water was pulverized using a sand mill to an average particle diameter of 1.5 μm, thus giving a developer dispersion (Dispersion (b)).

Preparation of Sensitizer Dispersion (Dispersion (c))

A composition comprising 20 parts of 1,2-di(3-methylphenoxy)ethane, 5 parts of a 5% aqueous solution of methylcellulose, and 55 parts of water was pulverized using a sand mill to an average particle diameter of 1.5 μm, thus giving a sensitizer dispersion (Dispersion (c)).

Preparation of Heat-sensitive Recording Layer Coating Composition

A composition comprising 25 parts of Dispersion (a), 50 parts of Dispersion (b), 50 parts of Dispersion (c), 50 parts of Silica Dispersion A, 30 parts of a 20% aqueous solution of oxidized starch, 10 parts of a 50% dispersion of light calcium carbonate (average particle diameter as measured by laser diffraction: 0.15 μm), and 50 parts of a 10% aqueous solution of acetoacetyl-modified polyvinyl alcohol (trade name: Gohsefimer Z-200, manufactured by Nippon Synthetic Chemical Industry Co., Ltd.) was mixed and stirred to give a heat-sensitive recording layer coating composition.

Preparation of Heat-sensitive Recording Material

The undercoat layer coating composition was applied to one side of a 48 $g/m^2$ base paper in an amount of 9.0 $g/m^2$ on a dry weight basis and dried. The heat-sensitive recording layer coating composition was then applied to the undercoat layer in an amount of 4.5 $g/m^2$ on a dry weight basis and dried. The paper thus coated was subsequently supercalendered to yield a heat-sensitive recording material having a smoothness of 1,000 to 4,000 seconds as measured by an Oken-type smoothness tester.

Example 2

A heat-sensitive recording material was prepared in the same manner as in Example 1, except that 50 parts of Silica Dispersion B was used instead of 50 parts of Silica Dispersion A.

Example 3

A heat-sensitive recording material was prepared in the same manner as in Example 1, except that 50 parts of Silica Dispersion E was used instead of 50 parts of Silica Dispersion A.

Example 4

A heat-sensitive recording material was prepared in the same manner as in Example 1, except that 25 parts of a commercially available silica dispersion (sample name: SP-382, manufactured by Grace Davison, concentration: 20%, pH: 6.8, average secondary particle diameter: 300 nm, average particle diameter of secondary particles: 300 nm, primary particle diameter: 16 nm, specific surface area: 190 $m^2/g$) was used instead of 50 parts of Silica Dispersion A.

Example 5

A heat-sensitive recording material was prepared in the same manner as in Example 1, except that 3-di(N-butyl) amino-7-anilinofluoran was used in Dispersion (a) instead of 3-(N-ethyl-N-isopentylamino)-6-methyl-7-anilinofluoran.

Example 6

A heat-sensitive recording material was prepared in the same manner as in Example 1, except that 4-hydroxy-4'-isopropoxydiphenylsulfone was used in Dispersion (b) instead of 3,3'-diallyl-4,4'-dihydroxydiphenylsulfone.

Example 7

A heat-sensitive recording material was prepared in the same manner as in Example 1, except that 7.5 parts of Silica Dispersion A was used instead of 50 parts of Silica Dispersion A.

Example 8

A heat-sensitive recording material was prepared in the same manner as in Example 1, except that 10 parts of a 50% dispersion of light calcium carbonate was not used.

Example 9

A heat-sensitive recording material was prepared in the same manner as in Example 1, except that 25 parts of a silica dispersion (Sylojet 703A, manufactured by Grace Davison, average secondary particle diameter: 300 nm, average particle diameter of secondary particles: 300 nm, primary particle diameter: 11 nm, concentration: 20%, specific surface area: 280 $m^2/g$, pH: 8.5) was used instead of 50 parts of Silica Dispersion A.

The above-described "average secondary particle diameter" is a value shown in the manufacturer's catalog. The "primary particle diameter" was determined in accordance with Equation (2) shown above, using the specific surface area value. The "average particle diameter of secondary particles" was determined by the procedure described in the section "average particle diameter of secondary particles" mentioned above.

Example 10

(1) Preparation of Protective Layer Coating Composition

A composition comprising 100 parts of a 10% aqueous solution of acetoacetyl-modified polyvinyl alcohol (trade name: Gohsefimer Z-200, manufactured by Nippon Synthetic Chemical Industry Co., Ltd., polymerization degree: 1,000), 40 parts of an acrylic resin (trade name: Bariastar-OT-1035-1, manufactured by Mitsui Chemicals Inc.; copolymer of (meth) acrylonitrile, alkyl(meth)acrylate, 2-hydroxyethyl (meth) acrylate, (meth)acrylic acid, and (meth)acrylamide, wherein the proportion of (meth)acrylic acid is 5 mass % of total mass of the copolymer resin; Tg: 50° C.; solids concentration: 25%), 20 parts of Silica Dispersion B, 2 parts of a 30% dispersion of zinc stearate and 20 parts of water was mixed and stirred to give a protective layer coating composition.

(2) Preparation of Heat-Sensitive Recording Material

The protective layer coating composition prepared in Section (1) above was applied in an amount of 2 $g/m^2$ on a dry weight basis over the heat-sensitive recording layer of the heat-sensitive recording material prepared in Example 2 and dried. The resulting material was then supercalendered to yield a heat-sensitive recording material having a smoothness of 1,000 to 4,000 seconds as measured by an Oken-type smoothness tester.

Example 11

(a) Preparation of Protective Layer Coating Composition

A protective layer coating composition was prepared in the same manner as in Example 10, except that 10 parts of a commercially available silica dispersion (Sylojet 703A, manufactured by Grace Davison, concentration: 20%, average secondary particle diameter: 300 nm, average particle diameter of secondary particles: 300 nm, primary particle diameter: 11 nm, specific surface area: 280 $m^2/g$) was used instead of Silica Dispersion B.

(b) Preparation of Heat-Sensitive Recording Material

The protective layer coating composition prepared in Section (a) above was applied in an amount of 2 $g/m^2$ on a dry weight basis over the heat-sensitive recording layer of the heat-sensitive recording material prepared in Example 2 and dried. The resulting material was then supercalendered to yield a heat-sensitive recording material having a smoothness of 1,000 to 4,000 seconds as measured by an Oken-type smoothness tester.

Example 12

(i) Preparation of Protective Layer Coating Composition

A protective layer coating composition was prepared in the same manner as in Example 10, except that Silica Dispersion D was used instead of Silica Dispersion B.

(ii) Preparation of Heat-Sensitive Recording Material

The protective layer coating composition prepared in Section (i) above was applied in an amount of 2 $g/m^2$ on a dry weight basis over the heat-sensitive recording layer of the heat-sensitive recording material prepared in Example 2 and dried. The resulting material was then supercalendered to yield a heat-sensitive recording material having a smoothness of 1,000 to 4,000 seconds as measured by an Oken-type smoothness tester.

Example 13

(aa) Preparation of Protective Layer Coating Composition

A protective layer coating composition was prepared in the same manner as in Example 10, except that Silica Dispersion C was used instead of Silica Dispersion B.

(bb) Preparation of Heat-Sensitive Recording Material

The protective layer coating composition prepared in Section (aa) above was applied in an amount of 2 $g/m^2$ on a dry weight basis over the heat-sensitive recording layer of the heat-sensitive recording material prepared in Example 2 and dried. The resulting material was then supercalendered to yield a heat-sensitive recording material having a smoothness of 1,000 to 4,000 seconds as measured by an Oken-type smoothness tester.

Comparative Example 1

A heat-sensitive recording material was prepared in the same manner as in Example 1, except that 50 parts of Silica Dispersion C was used instead of 50 parts of Silica Dispersion A.

Comparative Example 2

A heat-sensitive recording material was prepared in the same manner as in Example 1, except that 50 parts of Silica Dispersion F was used instead of 50 parts of Silica Dispersion A.

Comparative Example 3

A heat-sensitive recording material was prepared in the same manner as in Example 1, except that 25 parts of a colloidal silica (trade name: Snowtex 20, manufactured by Nissan Chemical Industries, Ltd., average primary particle diameter: 15 nm, colloidal silica consisting substantially of primary particles, and substantially free from secondary particles that are agglomerates of the primary particles, concentration: 20%) was used instead of 50 parts of Silica Dispersion A.

Comparative Example 4

A heat-sensitive recording material was prepared in the same manner as in Example 1, except that 50 parts of Silica Dispersion A was not added.

The 17 types of heat-sensitive recording materials thus obtained were evaluated for the following characteristics. The results are shown in Table 1.

Background Density

The density of the background was measured with a Macbeth densitometer (trade name: RD-914, manufactured by Macbeth) in visual mode.

Recording Density

Each heat-sensitive recording material was subjected to color development at 0.24 mJ/dot using a thermal recording tester (trade name: TH-PMD, manufactured by OKURA DENKI) to record an image. The density of the recorded portion was measured with a Macbeth densitometer (trade name: RD-914, manufactured by Macbeth) in visual mode.

Anti-Sticking Properties (1)

Each heat-sensitive recording material was subjected to color development at 0.40 mJ/dot using a thermal recording tester (trade name: TH-PMD, manufactured by OKURA DENKI), and the amount of residue adhered to the thermal head was visually observed and rated as follows:

A: Free of residue; no problem

B: Adhesion of a slight amount of residue; no practical problems

C: Adhesion of residue; problematic

Anti-Sticking Properties (2)

Each heat-sensitive recording material was printed with a 0.5 cc UV ink (trade name: Bestcure STP indigo blue W, manufactured by T&K Toka Co., Ltd.) using an RI printer (manufactured by Akira Seisakusho Corporation), and the printed heat-sensitive recording material was irradiated with ultraviolet light using a UV irradiator (trade name: "EYE GRANDAGE", manufactured by Eyegraphics, Co., Ltd.; lamp power: 1.5 kW; conveyor speed: 812 m/min) to cure the UV ink. The printed portion of the resulting heat-sensitive recording material was subjected to color development at 0.40 mJ/dot using a thermal recording tester (trade name: TH-PMD, manufactured by OKURA DENKI), and the amount of residue adhered to the thermal head was visually observed and rated as follows:

A: Free of residue; no problem

B: Adhesion of a slight amount of residue; no practical problems

C: Adhesion of residue; problematic

Anti-Scratching Properties

The background of each heat-sensitive recording material was scratched with a fingernail, and the degree of resulting coloration was visually observed and rated as follows:

A: No coloration observed; no problem

B: Slight coloration observed; no practical problems

C: Coloration observed; problematic

TABLE 1

| | Amorphous silica in heat-sensitive recording layer | | | Amorphous silica in protective layer | | | | | | |
|---|---|---|---|---|---|---|---|---|---|---|
| | Primary particle diameter (nm) | Average particle diameter of secondary particles (nm) | Basic pigment | Primary particle diameter (nm) | Average particle diameter of secondary particles (nm) | Back-ground density | Recording density | Anti-Sticking properties (1) | Anti-sticking properties (2) | Anti-scratching properties |
| Ex. 1 | 10 | 100 | $CaCO_3$ | — | — | 0.06 | 1.53 | A | A | A |
| Ex. 2 | 12 | 300 | $CaCO_3$ | — | — | 0.06 | 1.52 | A | A | A |
| Ex. 3 | 24 | 300 | $CaCO_3$ | — | — | 0.06 | 1.52 | A | A | A |
| Ex. 4 | 16 | 300 | $CaCO_3$ | | | 0.06 | 1.52 | A | A | A |
| Ex. 5 | 10 | 100 | $CaCO_3$ | — | — | 0.06 | 1.51 | A | A | A |
| Ex. 6 | 10 | 100 | $CaCO_3$ | — | — | 0.05 | 1.54 | A | A | A |
| Ex. 7 | 10 | 100 | $CaCO_3$ | — | — | 0.06 | 1.50 | B | B | A |
| Ex. 8 | 10 | 100 | — | — | — | 0.10 | 1.52 | A | A | B |
| Ex. 9 | 11 | 300 | $CaCO_3$ | — | — | 0.06 | 1.52 | A | A | A |
| Ex. 10 | 12 | 300 | $CaCO_3$ | 12 | 300 | 0.06 | 1.48 | A | A | A |
| Ex. 11 | 12 | 300 | $CaCO_3$ | 11 | 30 | 0.06 | 1.48 | A | A | A |

TABLE 1-continued

| | Amorphous silica in heat-sensitive recording layer | | | Amorphous silica in protective layer | | | | | | |
|---|---|---|---|---|---|---|---|---|---|---|
| | Primary particle diameter (nm) | Average particle diameter of secondary particles (nm) | Basic pigment | Primary particle diameter (nm) | Average particle diameter of secondary particles (nm) | Back-ground density | Recording density | Anti-Sticking properties (1) | Anti-sticking properties (2) | Anti-scratching properties |
| Ex. 12 | 12 | 300 | $CaCO_3$ | 12 | 900 | 0.06 | 1.40 | A | A | A |
| Ex. 13 | 12 | 300 | $CaCO_3$ | 12 | 4500 | 0.06 | 1.35 | A | A | B |
| Comp. Ex. 1 | 12 | 4500 | $CaCO_3$ | — | — | 0.06 | 1.37 | A | A | C |
| Comp. Ex. 2 | 32 | 300 | $CaCO_3$ | — | — | 0.06 | 1.52 | C | C | A |
| Comp. Ex. 3 | 15* | —* | $CaCO_3$ | — | — | 0.06 | 1.53 | C | C | A |
| Comp. Ex. 4 | — | — | $CaCO_3$ | — | — | 0.07 | 1.46 | C | C | A |

*colloidal silica

The following conclusions can be drawn from the results of Table 1 shown above.

(a) When the primary particle diameter of amorphous silica included in the heat-sensitive recording layer exceeds 30 nm, the background density, recording density and anti-scratching properties are excellent, whereas the anti-sticking properties (1) and the anti-sticking properties (2) are poor (Comparative Example 2).

(b) Even though the primary particle diameter of amorphous silica included in the heat-sensitive recording layer is 30 nm or smaller, if the average particle diameter of secondary particles of amorphous silica in the heat-sensitive recording layer exceeds 900 nm, the background density, anti-sticking properties (1) and anti-sticking properties (2) are excellent, whereas the recording density and anti-scratching properties are poor (Comparative Example 1).

(c) When a colloidal silica is used, the background density, recording density and anti-scratching properties are excellent, whereas the anti-sticking properties (1) and anti-sticking properties (2) are poor (Comparative Example 3).

(d) When, however, the primary particle diameter of amorphous silica in the heat-sensitive recording layer is 30 nm or smaller, and the average particle diameter of secondary particles is 900 nm or smaller, the background density, recording density, anti-sticking properties (1), anti-sticking properties (2) and anti-scratching properties are all satisfactory (Examples 1 to 9).

(e) When the protective layer includes amorphous silica, and especially when the amorphous silica in the protective layer has a primary particle diameter of 30 nm or smaller and an average particle diameter of secondary particles of 30 to 900 nm, the background density, recording density, anti-sticking properties (1), anti-sticking properties (2) and anti-scratching properties are all satisfactory (Examples 10 to 13).

The invention claimed is:

1. A heat-sensitive recording material comprising:

a support;

a heat-sensitive recording layer that comprises at least a leuco dye, a developer, a binder and a pigment; and a protective layer that comprises a pigment and a binder;

the pigment in the heat-sensitive recording layer being secondary particles with an average particle diameter of 30 to 900 nm formed by aggregation of amorphous silica primary particles with a particle diameter of at least 3 nm and less than 30 nm, and the pigment in the protective layer being secondary particles with an average particle diameter of 30 to 900 nm formed by aggregation of amorphous silica primary particles with a particle diameter of 3 to 70 nm.

2. A heat-sensitive recording material according to claim 1, wherein the pigment in the heat-sensitive recording layer is composed of secondary particles with an average particle diameter of 50 to 500 nm formed by aggregation of amorphous silica primary particles with a particle diameter of 5 to 27 nm.

3. A heat-sensitive recording material according to claim 1, wherein the beat-sensitive recording layer further comprises a basic pigment.

4. A heat-sensitive recording material according to claim 3, wherein the basic pigment is at least one member selected from the group consisting of magnesium carbonate, magnesium silicate, light calcium carbonate, ground calcium carbonate and aluminum hydroxide.

5. A heat-sensitive recording material according to claim 3, wherein the basic pigment is present in a proportion of 1 to 15 mass % relative to total solids of the heat-sensitive recording layer.

6. A heat-sensitive recording material according to claim 1, wherein the secondary particles in the heat-sensitive recording layer are present in a proportion of 1 to 35 mass % relative to total solids of the heat-sensitive recording layer.

7. A heat-sensitive recording material according to claim 1, wherein the pH of a 5 mass % aqueous dispersion of the secondary particles in the heat-sensitive recording layer is from 5.5 to 10.0.

8. A heat-sensitive recording material according to claim 1, wherein the binder in the heat-sensitive recording layer is a polyvinyl alcohol or a modified polyvinyl alcohol.

9. A heat-sensitive recording material according to claim 8, wherein the binder in the heat-sensitive recording layer is acetoacetyl-modified polyvinyl alcohol.

10. A heat-sensitive recording material according to claim 1, wherein the pigment in the protective layer is composed of secondary particles with an average particle diameter of 40 to 700 nm formed by aggregation of amorphous silica primary particles with a particle diameter of 5 to 50 nm.

11. A heat-sensitive recording material according to claim 1, wherein the secondary particles in the protective layer are present in a proportion of 1 to 40 mass % relative to total solids of the protective layer.

12. A heat-sensitive recording material according to claim 1, wherein the protective layer further comprises at least one pigment selected from the group consisting of kaolin, light calcium carbonate, ground calcium carbonate, calcined kaolin, titanium oxide, magnesium carbonate, aluminum hydroxide, colloidal silica, synthetic layered mica, plastic pigments such as urea-formalin resin fillers and the like.

13. A heat-sensitive recording material according to claim 1, wherein the binder in the protective layer is an acrylic resin, the acrylic resin being present in a proportion of 10 to 70 mass % relative to total solids of the protective layer.

14. A heat-sensitive recording material according to claim 13, wherein the acrylic resin is a copolymer of (a) (meth) acrylonitrile and (b) a vinyl monomer copolymerizable with (meth) acrylonitrile.

15. A heat-sensitive recording material according to claim 13, wherein the acrylic resin is a copolymer of:

(xi) at least one monomer selected from the group consisting of acrylonitrile and methacrylonitrile; and (iii) at least one monomer selected from the group consisting of alkyl or hydroxyalkyl esters of acrylic acid and methacrylic acid;

the copolymer having a glass transition temperature Tg of −10 to 100° C., or a copolymer of:

(xi) at least one monomer selected from the group consisting of acrylonitrile and methacrylontrile;

(iii) at least one monomer selected from the group consisting of alkyl or hydroxyalkyl esters of acrylic acid and methacrylic acid;

(i) at least one monomer selected from the group consisting of acrylic acid and methacrylic acid; and (vi) at least one monomer selected from the group consisting of acrylamide, methacrylamide, N-methylolacrylamide, N-methylolmethacrylamide, and like acrylamide compounds; the copolymer having a glass transition temperature Tg of 30 to 100° C.

16. A heat-sensitive recording material according to claim 13, wherein the protective layer further comprises a water-soluble resin.

17. A heat-sensitive recording material according to claim 16, wherein the water-soluble resin is a polyvinyl alcohol or a modified polyvinyl alcohol, the polyvinyl alcohol or modified polyvinyl alcohol being present in a proportion of 25 to 600 mass % based on total solids of the acrylic resin.

18. A heat-sensitive recording material according to claim 16, wherein the water-soluble resin is acetoacetyl-modified polyvinyl alcohol with a polymerization degree of 500 to 5,000.

19. A heat-sensitive recording material according to claim 16, wherein the water-soluble resin is diacetone-modified polyvinyl alcohol.

20. A heat-sensitive recording material according to claim 1, further comprising an undercoat layer between the support and the heat-sensitive recording layer.

21. A heat-sensitive recording material according to claim 1, comprising a printed portion on the protective layer.

* * * * *